US012208939B2

(12) United States Patent
Ohkoshi et al.

(10) Patent No.: US 12,208,939 B2
(45) Date of Patent: Jan. 28, 2025

(54) CAN LID

(71) Applicant: DAIWA CAN COMPANY, Chiyoda-ku (JP)

(72) Inventors: Toshiyuki Ohkoshi, Chiyoda-ku (JP); Hirokazu Konagaya, Shizuoka (JP); Tadayoshi Iwamaru, Mohka (JP); Akira Yamamoto, Mohka (JP); Katsumi Ohshima, Mohka (JP)

(73) Assignee: DAIWA CAN COMPANY, Chiyoda-ku (JP)

( * ) Notice: Subject to any disclaimer, the term of this patent is extended or adjusted under 35 U.S.C. 154(b) by 627 days.

(21) Appl. No.: 17/261,422

(22) PCT Filed: Jul. 2, 2019

(86) PCT No.: PCT/JP2019/026207
§ 371 (c)(1),
(2) Date: Jan. 19, 2021

(87) PCT Pub. No.: WO2020/017311
PCT Pub. Date: Jan. 23, 2020

(65) Prior Publication Data

US 2021/0300621 A1 Sep. 30, 2021

(30) Foreign Application Priority Data

Jul. 20, 2018 (JP) ..... 2018-137190

(51) Int. Cl.
*B65D 17/28* (2006.01)
*B65D 17/353* (2006.01)

(52) U.S. Cl.
CPC ..... *B65D 17/4011* (2018.01); *B65D 17/353* (2018.01); *B65D 2517/0016* (2013.01);
(Continued)

(58) Field of Classification Search
CPC ..... B65D 17/4011; B65D 17/353; B65D 2517/0016; B65D 2517/0071; B65D 2517/0073
(Continued)

(56) References Cited

U.S. PATENT DOCUMENTS 3,186,582 A * 6/1965 Henchert ..... B65D 17/4011 D9/518
3,362,569 A * 1/1968 Geiger ..... B21D 51/383 220/268
(Continued)

FOREIGN PATENT DOCUMENTS

JP 63-141146 U 9/1988
JP 2-46463 B2 10/1990
(Continued)

OTHER PUBLICATIONS

International Search Report issued on Aug. 27, 2019 in PCT/JP2019/026207 filed on Jul. 2, 2019.
(Continued)

*Primary Examiner* — Robert J Hicks
*Assistant Examiner* — Sanjidul Islam
(74) *Attorney, Agent, or Firm* — Oblon, McClelland, Maier & Neustadt, L.L.P.

(57) ABSTRACT

A can lid is provided to be made of a steel plate and easy to be opened. An opening piece is enclosed by a score line formed on a periphery of a panel portion. An installation portion of a tab is attached to the opening piece at a site close to a circumference of the opening piece. The tab includes a finger grip portion that is situated closer to a center of the opening piece than the installation portion, and a nose portion that is situated on an opposite side to the finger grip portion at a radially outer side of the score line. A portion of the panel portion underneath the nose portion serves as a
(Continued)

support section that supports the nose portion from below. An outer circumferential bead is formed on a radially outer side of the score line to enhance a bending stiffness of the support section.

9 Claims, 4 Drawing Sheets

(52) U.S. Cl.
CPC ..... *B65D 2517/0071* (2013.01); *B65D 2517/0073* (2013.01)

(58) Field of Classification Search
USPC ..... 220/269
See application file for complete search history.

(56) References Cited

U.S. PATENT DOCUMENTS

| | | | | |
|---|---|---|---|---|
| 3,724,709 | A * | 4/1973 | Westphal | B65D 17/4011 220/273 |
| 4,915,246 | A | 4/1990 | Nosaka et al. | |
| 2006/0060582 | A1 * | 3/2006 | Martinez Gomez | B65D 17/4011 220/269 |
| 2007/0131693 | A1 | 6/2007 | Matsukawa et al. | |
| 2008/0197132 | A1 | 8/2008 | Hasegawa et al. | |
| 2017/0029194 | A1 * | 2/2017 | Dunn | B65D 79/008 |

FOREIGN PATENT DOCUMENTS

| | | | |
|---|---|---|---|
| JP | 3-54020 | Y2 | 11/1991 |
| JP | 9-301365 | A | 11/1997 |
| JP | 2000-318733 | A | 11/2000 |
| JP | 2003-326663 | A | 11/2003 |
| JP | 2004-161360 | A | 6/2004 |
| TW | M509773 | U | 10/2015 |

OTHER PUBLICATIONS

English machine translation of Notice of Reasons for Refusal issued Dec. 20, 2022 in Japanese Patent Application No. 2020-531215, 3 pages.
Search Report issued on Feb. 3, 2023, in the Taiwanese Application No. 108124861, 1 page.

* cited by examiner

CAN LID

TECHNICAL FIELD

The present invention relates to a full-open type can lid that is opened substantially entirely, and especially to a can lid that is opened by pulling a tab along a score line.

BACKGROUND ART

Can lids of this kind are described in patent documents 1 to 3. Here will be explained a basic structure of the can lid. In the can lid of this kind, a panel portion is enclosed by a score line formed inside of a periphery of the panel portion seamed to a can trunk in a substantially circular manner. The panel portion thus enclosed by the score line serves as an opening piece. The tab is fixed to a radially outer portion of the opening piece by a rivet. The score line is partially ruptured by lifting the tab, and further ruptured by lifting up the tab. Specifically, a tip of the tab (a tab nose) extends from the rivet toward a peripheral edge of the opening piece, and a finger grip extends from the other side of the rivet toward a center of the opening piece.

When the finger grip is lifted, the score line is ruptured by a principle of a class 1 lever action or a class 2 lever action. The patent document 1 describes an example of causing initial rupture of the score line by a principle of the class 2 lever action. Here will be simply explained teachings of the patent document 1. In the can lid taught by the patent document 1, an initial rupture of the score line is induced in the vicinity of a rivet by lifting the rivet by the class 2 lever action of the tab. The score line is not formed into a true circle, and a semi-circular section is formed around the rivet. Specifically, in the score line, an arcuate section enclosing a most part of the opening piece is joined to the semi-circular section via a straight section formed parallel to a line extending perpendicular to a radius line passing through a center of the rivet and a center of the can lid. The tab nose is shaped into an arcuate shape concentrically with the arcuate section of the score line. According to the teachings of the patent document 1, therefore, a shearing force can be applied certainly to the arcuate section to rupture the score line in an initial phase so that the can lid can be opened easily.

The patent document 2 describes a can lid in which a score line is ruptured initially by the class 1 lever action of a tab. In the can lid taught by the patent document 2, in order to protect a finger from an edge of a ruptured score line, a safety bead is formed along inside of the score line. The safety bead protrudes upwardly from the can lid, and hence stiffness against bending stress of an opening piece is enhanced. Specifically, in the can lid taught by the patent document 2, the safety bead is formed in an arcuate manner in which both ends are situated at a folding line extending perpendicular to the radius line described in the example according to the patent document 1. Therefore, a portion of the opening piece underneath the tab nose is bent easily along the folding line by pushing downwardly by the tab nose to rupture the score line. That is, the initial rupture of the score line can be facilitated by the safety bead without warpage of the opening piece.

The patent document 3 also describes a can lid in which a score line is ruptured initially by the class 1 lever action of a tab. In the can lid taught by the patent document 3, the score line is formed in a circular (or round) manner. The score line is ruptured initially by the tab, and the rupture of the score line is propagated by lifting up the tab. In this situation, if the rupture of the score line is propagated abruptly, the content may be spilled out of a container. In order to avoid such disadvantage, according to the teachings of the patent document 3, a residual thickness of the score line is partially increased thicker than the remaining portion. In addition, in the can lid taught by the patent document 3, the score line is formed not only on a top surface but also on a bottom surface, and one of the score lines comprises a wider first groove formed on the surface of the can lid and a narrower second groove formed along a center of the first groove in the width direction. In addition, a flat portion extending parallel to the top surface or the bottom (or inner) surface is formed between the first groove and the second groove.

PRIOR ART DOCUMENT

Patent Literature

Patent Document 1: JP H02-46463 B.
Patent Document 2: JP H03-54020 Y.
Patent Document 3: JP 2004-161360 A.

SUMMARY OF INVENTION

Technical Problem to be Solved by the Invention

Thus, according to the teachings of the patent document 1, an opening force can be applied certainly and effectively to the score line even if the tab is rotated around the rivet, by the class 2 lever action in which the tab nose serves as a fulcrum. In the can lid taught by the patent document 1, specifically, an arcuate section of the panel portion between the rivet and a tip of the tab nose serves as a pivot point of the leverage. However, as the opening piece, the arcuate section serving as a pivot point is a flat panel section, therefore, not only the arcuate section but also the opening piece are easy to be bent or buckled. That is, the arcuate section serving as the pivot point to establish a downward pushing force by the tab nose may be buckled when the finger grip is lifted. Consequently, the opening force may be absorbed by a deformation or displacement of the arcuate section serving as the pivot point, and hence the score line may not be ruptured immediately. For these reasons, the can lid may not be opened easily.

In addition, in the can lid taught by the patent document 1, the initial rupture of the score line is induced by the class 2 lever action of the tab, and the score line is further ruptured by the class 2 lever action of the tab. That is, not only the initial rupture (i.e., score break) but also the propagation of the score line are induced by lifting the opening piece. Therefore, a continuity of an opening operation of the can lid may be ensured so that the openability of the can lid may be improved in this point. However, in the can lid taught by the patent document 1, the semi-circular section of the score line that is ruptured initially is joined to the arcuate section of the main score line formed on an outer circumferential side through the straight section. That is, a large shearing force is required to rupture the straight section, and hence the straight section is ruptured abruptly. Thus, the can lid taught by the patent document 1 is not easy to be opened.

On the other hand, in the can lids described in the patent documents 2 and 3, the initial rupture of the score line is induced by the class 1 lever action of the tab, respectively. As described, in the can lid taught by the patent document 2, both ends of the safety bead are situated at the folding line so that the section of the opening piece between the folding line and the tab nose is easy to be buckled inwardly. Therefore, if the can lid (having the safety bead) taught by the patent document 2 is modified to be opened by the class 2 lever action of the tab, as the can lid taught by the patent document 1, openability of the can lid may be reduced due to lack of stiffness of the supporting point underneath the tab nose. Such disadvantage may also be expected in the can lid taught by the patent document 3 in which the initial rupture is induced by the class 1 lever action of the tab.

In addition, in any of the can lids described in the patent documents 1, 2, and 3, a reaction force against the opening force to lift the opening piece is received by a ring-shaped portion (as will be temporarily called the residual ring portion hereinafter) that is seamed to the can trunk. However, the residual ring portion is a flat portion as a part of the panel portion joining to an annular groove formed on an outer circumferential side of the opening piece. Therefore, the residual ring portion is easy to be buckled by the opening force. For this reason, the opening force may not be concentrated on the score line, and the score line may not be ruptured smoothly. That is, the can lid may not be opened easily. Such disadvantage may also be expected when detaching the opening piece. Specifically, when the opening piece is detached from the residual ring portion, the residual ring portion may be buckled partially, and hence the score line may not be ruptured neatly. Consequently, a burr may be formed to protrude from the residual ring portion. In addition, a large opening force is required in a final phase to detach the opening piece from the residual ring portion.

The present invention has been conceived noting the foregoing technical problems, and it is therefore an object of the present invention to provide a can lid that can be opened easily by inducing an initial rupture of a score line smoothly and certainly.

Means for Solving the Problem

According to one aspect of the present invention, there is provided a can lid, that has an opening piece enclosed by a score line on a panel portion, and that is opened by a tab attached to the opening piece that ruptures the score line and detaches the opening piece from the panel portion. In order to achieve the above-explained objective, according to the present invention, the score line is formed into a closed circle to be ruptured easily along a circumference of the panel portion, and a rivet is formed in the vicinity of a circumference of the panel portion. The tab comprises an installation portion that is attached to the rivet, a finger grip portion that is situated closer to a center of the opening piece than the installation portion, and a nose portion that is situated on an opposite side to the finger grip portion at radially outer side of the score line. A portion of the panel portion underneath the nose portion serves as a support section that supports the nose portion from below; and an outer circumferential bead is formed on a radially outer side of the score line to enhance bending stiffness of the support section.

According to the present invention, the outer circumferential bead may include end portions situated on both sides of the support section in a circumferential direction of the panel portion, and the outer circumferential bead may be formed along an outer circumference of the score line while being protruded toward an outer surface of the panel portion.

According to the present invention, the score line may comprise: a marginal portion that is formed in an arcuate manner along an outer circumference of the rivet between the support section and the rivet; a main portion that is formed along the outer circumferential bead in an arcuate manner around the center of the panel portion; and a connecting portion that connects the main portion and the marginal portion while being curved.

According to the present invention, an inner circumferential bead may be formed on the opening piece along an inner circumference of the score line.

According to the present invention, the inner circumferential bead may have an open configuration in which end portions thereof are situated on both sides of the rivet.

According to the present invention, at least the panel portion may be formed of a metal plate in which both an outer surface and an inner surface are coated with a resin film respectively, and the resin film may be solidified into amorphous.

According to the present invention, the resin film covering the outer surface of the panel portion may contain more than 50 percent of polybutylene terephthalate.

Advantageous Effects of Invention

According to the present invention, the tab is lifted by a finger to perform the class 2 lever action in which the finger grip serves as a point of effort, the nose portion serves as a fulcrum, and installation portion attached to the panel portion through the rivet serves as a point of load. Consequently, the rivet is lifted up and the score line extending in the vicinity of the rivet is ruptured initially. In this situation, since bending stiffness of the support section to which the nose portion is contacted is enhanced by the outer circumferential bead, an opening force established by lifting the finger grip portion will not be absorbed by warpage of the support section. Therefore, the opening force is concentrated on the score line to serve as a shearing force. That is, an initial rupture of the score line is induced without increasing a lifting force applied to the finger grip portion and without lifting the finger grip portion excessively. For this reason, the score line can be ruptured easily at an initial phase to open the can lid to open the can lid easily.

Since the outer circumferential bead protrudes toward the outer surface of the panel portion, the panel portion may be defined precisely from the chuck wall formed on the outer circumferential side, and the bending stiffness of the support section may be enhanced certainly.

The score line comprises: the arcuate main portion formed along the outer circumference of the panel portion; the arcuate marginal portion formed along the rivet; and the curved connecting portion connecting the main portion to the marginal portion. Therefore, rupture (i.e., shearing) of the score line propagates gradually so that the opening piece is allowed to be opened smoothly by a constant force. For this reason, the easiness to open the can lid may be further improved.

Further, the bending stiffness of the panel portion is enhanced by the inner circumferential bead at the outer circumferential side and the inner circumferential side of the score line. Therefore, the shearing force can be concentrated to the score line to rupture the score line smoothly. For this reason, the easiness to open the can lid may be further improved. Furthermore, the inner circumferential bead and the outer circumferential bead are substantially congruent with an edge of the opening piece created by rupturing the score line. Therefore, the finger may be prevented from being injured by the edge. That is, safety of the can lid may be improved.

In addition, the resin films covering the inner and outer surfaces of the can lid are solidified into amorphous. Therefore, those films are not allowed to be expanded, and easy to be ruptured. For this reason, the easiness to open the can lid may be further improved. When seaming the can lid to a can trunk, the resin films may be deformed with a deformation of a flange of the can lid but without stretching. Therefore, the can lid may be seamed easily to the can trunk.

For example, the outer surface of the can lid is coated with the resin film containing mainly polybutylene terephthalate resin. Therefore, crystallization and partial albescence of the resin film such as might be caused by the crystallization of the resin film may be prevented. For this reason, appearance of the can lid or a can container may be maintained in good condition.

DESCRIPTION OF EMBODIMENT(S)

The present invention relates to a so-called "full-open type" can lid. A main body of the can lid is attached (or seamed) to a can trunk, and a panel portion is formed at the central section of the main body. A major part of the panel portion is occupied by an opening piece defined by a score line, and a tab having a finger grip is attached to the opening piece by a rivet in the vicinity of a periphery of the opening piece. The score line is partially ruptured by lifting the finger grip, and the rupture of the score line propagates gradually from a portion at which the score line is ruptured initially. Eventually, the score line is ruptured entirely so that the opening piece is detached from the main body, and consequently the can lid is opened.

Figure 1:
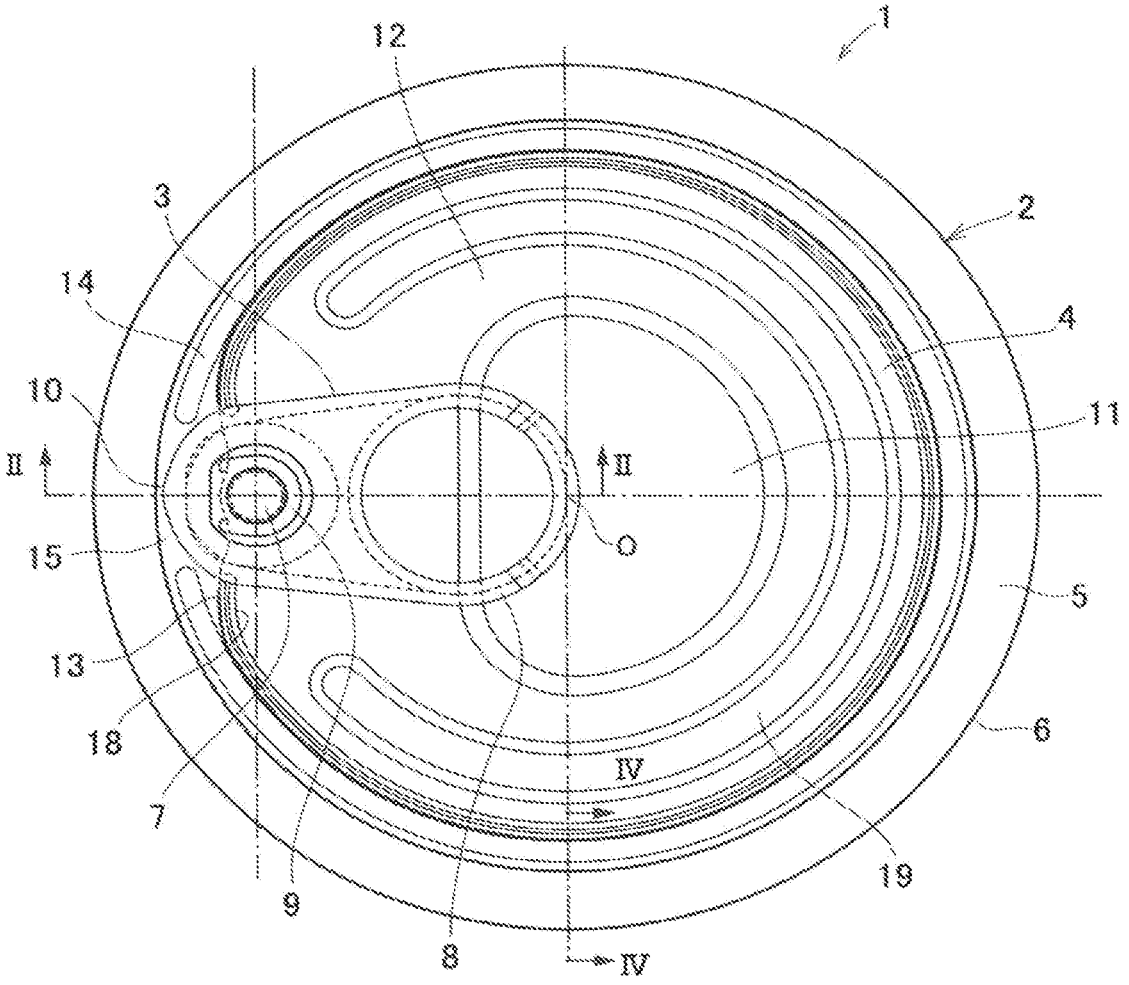
FIG. 1 is a front view showing one example of a fundamental structure of a can lid according to the present invention.
Figure 2:
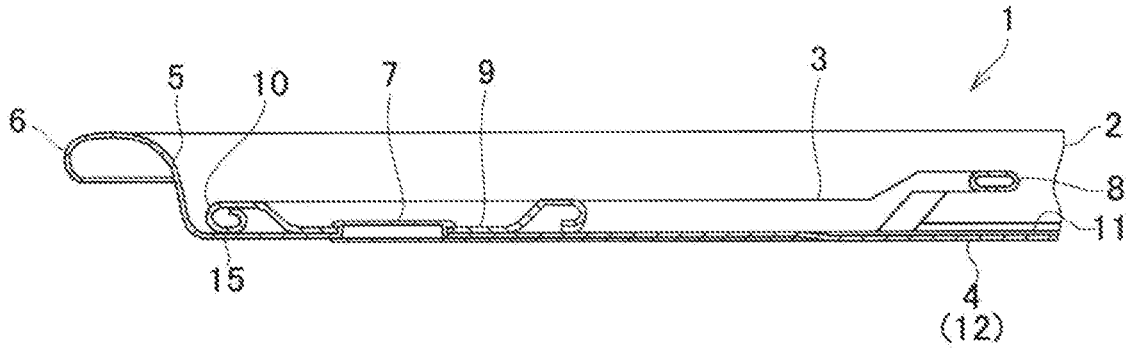
FIG. 2 is a cross-sectional view along the II-II line drawn in FIG. 1.

Specifically, as illustrated in FIGS. 1 and 2, a can lid 1 according to the present invention comprises a main body 2 and a tab 3. The main body 2 is a circular plate member made of aluminum alloy plate material or a surface-treated steel plate material whose contour is congruent with a not shown can trunk. Especially, a surface-treated steel plate such as a tin-free steel and a low tin steel is preferable to form the main body 2. Optionally, both surface of the steel plate material may be coated with a synthetic resin film.

For example, an outer surface of the can lid 1 may be coated with a resin file containing mainly polybutylene terephthalate resin (e.g., equal to or more than 50%), and polyethylene terephthalate. By using the above-mentioned resin film, crystallization of the film and partial albescence of the film such as might be caused by the crystallization of the film may be prevented so as to retain appearance of the can lid or a can container in good condition. On the other hand, a multi-layered resin film e.g., a three-layered resin film is applied to an inner surface of the can lid. For example, in the three-layered resin film, an inner layer to be contacted to the can lid 1, and an outer layer are formed mainly of isophthalic acid copolymerized polyester resin, respectively. In order to ensure flexibility of the three-layered resin film, an intermediate layer interposed between the inner layer and the outer layer is formed mainly of dimer acid copolymerized polyester resin. The three-layered resin film is attached to the can lid 1 with an adhesive agent made of resin material that does not contain Bis Phenol A. By thus employing the above-mentioned three-layered resin film to the inner surface of the can lid 1, the score line may be formed without damaging the film. That is, quality of the inner surface of the can lid 1 may be ensured. Both of the resin film applied to the outer surface of the can lid 1 and the resin film applied to the inner surface of the can lid 1 are subjected to a thermal treatment to be solidified into amorphous.

The can lid 1 is formed by pressing a blank made of the above-mentioned metal plate material. As illustrated in FIGS. 1 and 2, a chuck wall 5 to be fixed to the can trunk is formed around a periphery of a circular (or a disc) panel portion 4, and a flange 6 is formed around a circumference of the chuck wall 5 to be seamed to the can trunk. A rivet 7 is formed in the vicinity of the circumference of the panel portion 4 by projecting the panel portion partially (i.e., upwardly in FIG. 2) so that the tab 3 is attached to the panel portion 4 through the rivet 7.

The tab 3 is a separate body from the main body 2 serving as a knob to open the can lid 1, and fixed to the panel portion 4 by the rivet 7. For example, the tab 3 is formed by pressing a steel plate. The tab 3 comprises a finger grip portion 8, an installation portion 9 to which the rivet 7 is inserted, and a nose portion 10 serving as a fulcrum of leverage. The finger grip portion 8, the installation portion 9, and the nose portion 10 are formed in order along a common axis so that the tab 3 is shaped into a substantially oval shape. In order to ensure a desired rigidity, a peripheral edge of the tab 3 is folded downwardly so that the tab 3 has a two-layered structure or a curled structure.

The finger grip portion 8 is shaped into a ring shape, and a tip of the finger grip portion 8 is situated on a center O of the can lid 1. A portion of the finger grip portion 8 close to the center O is thinned so as to leave the outer surface of the panel portion 4. In addition, a dent 11 is formed on the panel portion 4 underneath the thinned portion of the finger grip portion 8 so as to allow a finger to enter easily into a space between the finger grip portion 8 and the panel portion 4. Specifically, a predetermined area of the panel portion 4 is depressed inwardly (i.e., downwardly) to form the dent 11 underneath the thinned portion of the finger grip portion 8.

The installation portion 9 is a lip (or a tongue) to which the rivet 7 is inserted, and fixed to the panel portion 4 by crushing an outer (or top) portion of the rivet 7. Specifically, the installation portion 9 extends from the nose portion 10 toward the finger grip portion 8 while being enclosed by an arcuate slit formed around the rivet 7. That is, the installation portion 9 is isolated away from the finger grip portion 8. Therefore, the finger grip portion 8 can be lifted while keeping the installation portion 9 and the rivet 7 to be connected to the panel portion 4 in an initial phase of lifting the finger grip portion 8. For this reason, in addition to the advantage of the dent 11, the finger is allowed to be inserted further easily into the finger grip portion 8.

The nose portion 10 is situated on a radially outermost portion of the panel portion 4 while being opposed to the circumference of the panel portion 4. In other words, the nose portion 10 is situated slightly inside of the chuck wall 5. In a case of forming an annular groove between the chuck wall 5 and the panel portion 4, the nose portion 10 is situated slightly inside (i.e., an inner circumferential side) of the annular groove.

The tab 3 is fixed to the panel portion 4 while being contacted to the flat upper (or outer) surface of the panel portion 4. Specifically, the nose portion 10 is contacted tightly to the upper surface of the panel portion 4. On the other hand, the portion of the finger grip portion 8 close to the center O is situated above the dent 11 while keeping a predetermined clearance from the upper (or outer) surface of the dent 11.

Figure 3:
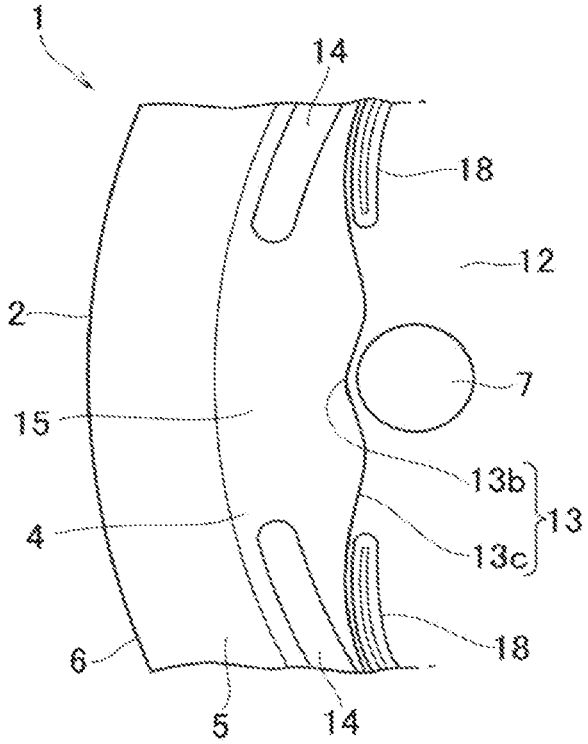
FIG. 3 is a partial view showing configurations in the vicinity of a support section.
Figure 4:
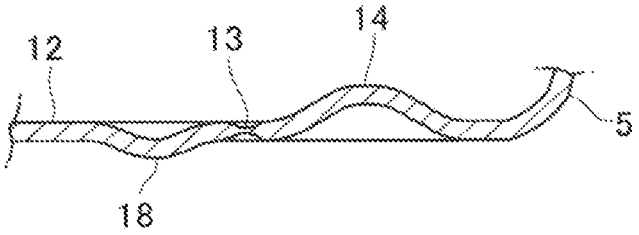
FIG. 4 is an enlarged cross-sectional view along the IV-IV line drawn in FIG. 1.

A score line 13 is formed along the circumference of the panel portion 4 so that the most part of the panel portion 4 enclosed by the score line 13 serves as an opening piece 12 that is to be detached from the can lid 1. As illustrated in FIGS. 1 and 3, in order to enhance bending stiffness of a portion expanding outside of the score line 13 (as will be called the residual ring portion hereinafter), a bead (as will be called the outer circumferential bead hereinafter) 14 is formed on a radially outermost portion of the panel portion 4, and the score line 13 is formed inside of the outer circumferential bead 14. A cross section of the outer circumferential bead 14 is shown in FIG. 4, and as illustrated in FIG. 4, the outer circumferential bead 14 protrudes upwardly from the panel portion 4.

As shown in FIG. 1, the outer circumferential bead 14 is an arcuate bead formed almost entirely along the circumference of the panel portion 4 except around a site at which the nose portion 10 of the tab 3 is contacted to the panel portion 4. In other words, the outer circumferential bead 14 is disconnected at a portion in the vicinity of the site at which the nose portion 10 of the tab 3 is contacted to the outer circumferential portion (i.e., the residual ring portion) of the panel portion 4. The portion of the panel portion 4 at which the outer circumferential bead 14 is disconnected, in other words, the portion of the panel portion 4 between end portions of the outer circumferential bead 14 serves as a support section 15 that supports the nose portion 10 so as to allow the nose portion 10 to serve as the fulcrum of the class 2 lever action of the tab 3. Since the support section 15 is formed between the end portions of the outer circumferential bead 14, rigidity of the support section 15 is enhanced by the outer circumferential bead 14 extending on both sides of the support section 15. That is, the support section 15 is difficult to be bent in its thickness direction. Optionally, the outer circumferential bead 14 may be extended to underneath the nose portion 10. In this case, in order not to push up the nose portion 10 by the outer circumferential bead 14, it is preferable to modify the outer circumferential bead 14 to reduce a thickness of the portion of the outer circumferential bead 14 situated underneath the nose portion 10. If a main purpose of forming the outer circumferential bead 14 is to enhance the rigidity of the support section 15, the outer circumferential bead 14 may be formed only on both sides of the support section 15, and the outer circumferential bead 14 may not be formed on the panel portion 4 on an opposite side to the support section 15 across the center O.

Figure 5:
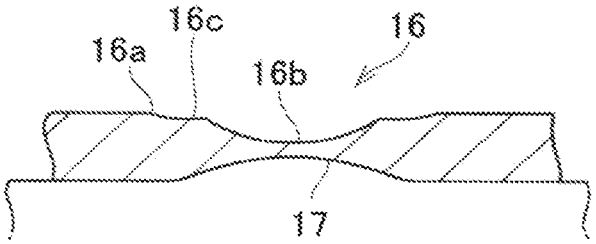
FIG. 5 is an enlarged cross-sectional view showing a cross-section of the score line.

A (residual) thickness of the score line is reduced so that the score line 13 may be ruptured or broken easily. As illustrated in FIG. 5, the score line 13 comprises an outer score line 16 formed on the outer surface of the panel portion 4, and an inner score line 17 formed on the inner surface of the panel portion 4. The residual thickness of the score line 13 is defined by a thickness of a thinnest portion between the outer score line 16 and the inner score line 17.

One of the outer score line 16 and the inner score line 17 (e.g., the outer score line 16 in the example shown in FIG. 5) has a two-step structure. Specifically, the outer score line 16 comprises a first groove 16*a* as a shallower and wider groove having an arcuate cross-section, and a second groove 16*b* as a deeper and narrower groove also having an arcuate cross-section. That is, a depth of the second groove 16*b* is defined as a distance between the outer surface of the panel portion 4 and a bottom of the second groove 16*b*. Accordingly, a distance between a bottom of the first groove 16*a* and the bottom of the second groove 16*b* may be identical to a depth of the first groove 16*a*, or shallower than the depth of the first groove 16*a*. An opening width of the second groove 16*b* at the bottom of the first groove 16*a* is narrower than a width of the bottom of the first groove 16*a* so that a flat portion 16*c* is formed between the first groove 16*a* and the second groove 16*b*. Specifically, the flat portion 16*c* extends parallel to the outer surface or inner surface of the panel portion 4.

The inner score line 17 is formed such that a width center of the inner score line 17 is aligned with a width center of the outer score line 16, and the inner score line 17 also has an arcuate cross-section. Specifically, a curvature radius of the inner score line 17 is longer than a curvature radius of the second groove 16*b*. A width of the inner score line 17 is narrower than the width of the first groove 16*a* but wider than the width of the second groove 16*b*. On the other hand, a depth of the inner score line 17 is substantially identical to the depth of the second groove 16*b*. That is, a total value of the depth of the inner score line 17 and the depth of the second groove 16*b* is less than the thickness of the panel portion 4. Accordingly, the residual thickness of the score line 13 may be calculated by subtracting the total value of the depths of the inner score line 17 and the second groove 16*b* from the thickness of the panel portion 4. According to the embodiment, a thinnest portion of the score line 13 is situated at a center of the thickness of the panel portion 4.

Since the widths of the first groove 16*a*, the second groove 16*b*, and the inner score line 17 are set to the above-mentioned manner, the flat portion 16*c* is partially opposed to the flat portion of the inner surface of the panel portion 4. In other words, the flat portion 16*c* partially overlaps with the flat portion of the inner surface of the panel portion 4 in the thickness direction of the panel portion 4. Therefore, when forming the outer score line 16 and the inner score line 17 simultaneously by sandwiching the panel portion 4 by an upper forming tool and a lower forming tool, the thinnest portion of the score line 13 may be accurately formed at the center of the thickness of the panel portion 4. Specifically, the upper forming tool is pushed onto the outer surface of the panel portion 4 thereby pushing portions of the upper forming tool for forming the first groove 16*a* and the second groove 16*b* into the panel portion 4 in accordance with desired dimensions. Consequently, a portion of the panel portion to be shaped into the flat portion 16*c* is sandwiched by the upper forming tool and the lower forming tool forming the inner score line 17. In this situation, a resistance against the forming tools is increased and forming of the score lines will no longer progress. Therefore, the outer score line 16 will not be formed deeper than the desired depth, and the inner score line 17 will not be formed shallower than the desired depth. That is, the thinnest portion of the score line 13 will not be displaced upwardly or downwardly in the panel portion 4.

Here will be further explained cross-sectional shapes of the outer score line 16 and the inner score line 17. The first groove 16*a* and the second groove 16*b* have the arcuate cross-sections, respectively, except the flat portion 16*c*. Likewise, the inner score line 17 also has the arcuate cross-section. That is, the mold tools for forming the score lines 16 and 17 do not have sharp edges. According to the embodiment, the metal plate material coated with the resin film is used to form the can lid 1, therefore, the resin film will not be damaged by the mold tools when forming the score lines 16 and 17 whose cross-sections are arcuate. In other words, it is not necessary to touch up the resin film using coating material.

Figure 6:
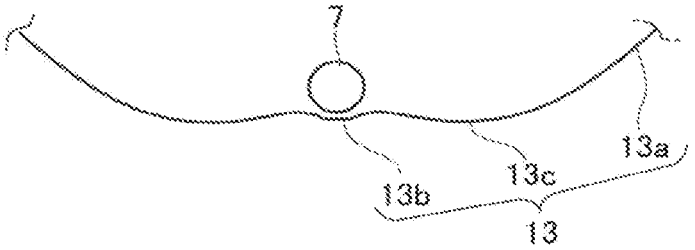
FIG. 6 is a partial view showing a configuration of the score line around a rivet.

In order to ensure an opening area of the can lid 1 as large as possible, the score line 13 is formed along the inner circumference of the outer circumferential bead 14. Specifically, the score line 13 is formed in an arcuate manner around the center O of the panel portion 4 along the outer circumferential bead 14, except in the vicinity of the rivet 7. Hereinafter, a portion of the score line 13 extending along the outer circumferential bead 14 will be called the main portion 13*a*. On the other hand, a portion in the vicinity of the rivet 7 is curved to approach the rivet 7 while extending along the outer circumference of the rivet 7. Hereinafter, the portion in the vicinity of the rivet 7 will be called the marginal portion 13*b*. As illustrated in FIGS. 1 and 6, the marginal portion 13*b* is formed close to the rivet 7 between the support section 15 and the rivet 7. Specifically, the marginal portion 13*b* is formed in an arcuate manner along the outer circumference of the rivet 7 to protrude toward the support section 15.

The main portion 13*a* is joined to the marginal portion 13*b* through a connecting portion 13*c* that is curved smoothly in a direction along the outer surface (i.e., the top surface). Specifically, the connecting portion 13*c* extends in the direction perpendicular to a line passing through the center of the rivet and the center O of the can lid 1 while curving smoothly viewed from the top. As described, the marginal portion 13*b* extends along the outer circumference of the rivet 7. Therefore, as illustrated in FIG. 6, a portion of the connecting portion 13*c* close to the marginal portion 13*b* is curved to protrude toward the center O of the can lid 1, and a portion of the connecting portion 13*c* extending toward the main portion 13*a* protrudes toward the support section 15. Since the connecting portion 13*c* is curved as explained above, the score line 13 can be ruptured (or sheared) smoothly and continuously, and hence the can lid 1 can be opened easily. In addition, an area of the residual ring portion can be reduced to widen an opening area as much as possible, and a reduction in rigidity can be prevented.

In order to enhance the bending stiffness of a portion along the inner side of the score line 13 (i.e., a circumferential portion of the opening piece 12), a bead (as will be called the inner circumferential bead hereinafter) 18 is formed along an inner circumference of the score line 13. A cross-section of the inner circumferential bead 18 is also shown in FIG. 4, and as illustrated in FIG. 4, the inner circumferential bead 18 is a depressed bead formed by depressing the panel portion 4 downwardly. As described, the score line 13 is formed into the closed circle. On the other hand, the inner circumferential bead 18 has an open configuration. Specifically, the inner circumferential bead 18 is formed along the main portion 13*a* and a part of the connecting portion 13*c* of the score line 13, and end portions of the inner circumferential bead 18 are situated on both sides of the rivet 7. Therefore, a forming process of the rivet 7 and a forming process of the inner circumferential bead 18 do not interfere with each other so that the rivet 7 and the inner circumferential bead 18 may be formed into desired configurations respectively in a stable manner. In addition, the bending stiffness of the portion of the opening piece 12 close to the rivet 7 may be enhanced. A distance between the end portions of the inner circumferential bead 18 may be adjusted as long as the above-explained advantages can be achieved. A depth and a width of the inner circumferential bead 18 may be shallower and narrower than those of the outer circumferential bead 14 as shown in FIG. 1. However, the depth and the width of the inner circumferential bead 18 may be identical to those of the outer circumferential bead 14.

In FIG. 1, the reference numeral 19 represents a reinforcement depression. The reinforcement depression 19 is formed to enhance the bending stiffness of the opening piece 12, and for this purpose, the reinforcement depression 19 is formed into a wide groove on the opening piece 12. Specifically, as illustrated in FIG. 1, the reinforcement depression 19 is formed into a C-shape around the center O of the can lid 1.

According to the present invention, the flange 6 of the can lid 1 is seamed to the can trunk (not shown). To this end, the resin film applied to the outer surface of the can lid 1 and the resin film applied to the inner surface of the can lid 1 are solidified into amorphous. Consequently, the films may be deformed without stretching when deforming (i.e., seaming) the flange 6 so that the flange 6 may be seamed easily to the can trunk. When opening the can lid 1 to take the contents from the can, the tab 3 is lifted by the finger inserted into the finger grip 8. In this situation, since the dent 11 is formed on the panel portion 4 to maintain a space underneath the finger grip portion 8, the finger is allowed to be inserted easily into the finger grip portion 8.

When a force is applied to the finger grip portion 8 to lift finger grip portion 8, the tab 3 is pivoted at the nose portion 10 serving as a fulcrum. In this situation, the installation portion 9 is separated from the finger grip portion 8 along the slit formed around the rivet 7, and the tab 3 is pulled up at an angle while keeping the installation portion 9 closely to the panel portion 4 (i.e., the opening piece 12). That is, an action to pull up the rivet 7 is not caused in an initial phase to lift the finger grip portion 8, therefore, the finger grip portion 8 may be lifted by a small force. In addition, since the clearance between the finger grip portion 8 being lifted and the panel portion 4 (i.e., the opening piece 12) can be increased by the small force, the finger is allowed to be further inserted easily into the finger grip portion 8.

Thus, when lifting the tab 3, the nose portion 10 is contacted to the support section 15 to serve as a fulcrum. As described, the support section 15 is formed on the outer circumferential portion of the panel portion 4 between the end portions of the outer circumferential bead 14. That is, although the outer circumferential bead 14 is not formed on the support section 15, the bending stiffness of the support section 15 is enhanced by the outer circumferential bead 14 extending on both sides of the support section 15. Therefore, when the finger grip 8 is lifted, the nose portion 10 is supported certainly by the support section 15 so that the tab 3 can be lifted certainly. In other words, the force for lifting the tab 3 will not be absorbed by a deformation or the like of the support section 15, and hence incompletion of lifting of the tab 3 can be prevented.

With the progress of the lifting of the tab 3, a deformation (i.e., a lift up) in the vicinity of the installation portion 9 will eventually exceed an allowable deformation of the installation portion 9 as a maximum upward deformation of the installation portion 9 without lifting the rivet 7. Accordingly, when the deformation of the installation portion 9 exceeds the allowable deformation, the rivet 7 is lifted by the tab 3 though the installation portion 9. Specifically, the tab 3 performs the class 2 lever action in which the finger grip 8 serves as the point of effort, the nose portion 10 serves as the fulcrum, and the portion connected to the rivet 7 (i.e., the installation portion 9) serves as the point of load. In this situation, since the rigidity of the support section 15 is enhanced, the nose portion 10 can be supported firmly so that the lifting force can be applied certainly to the installation portion 9 connected to the rivet 7 as the point of load.

Figure 7:
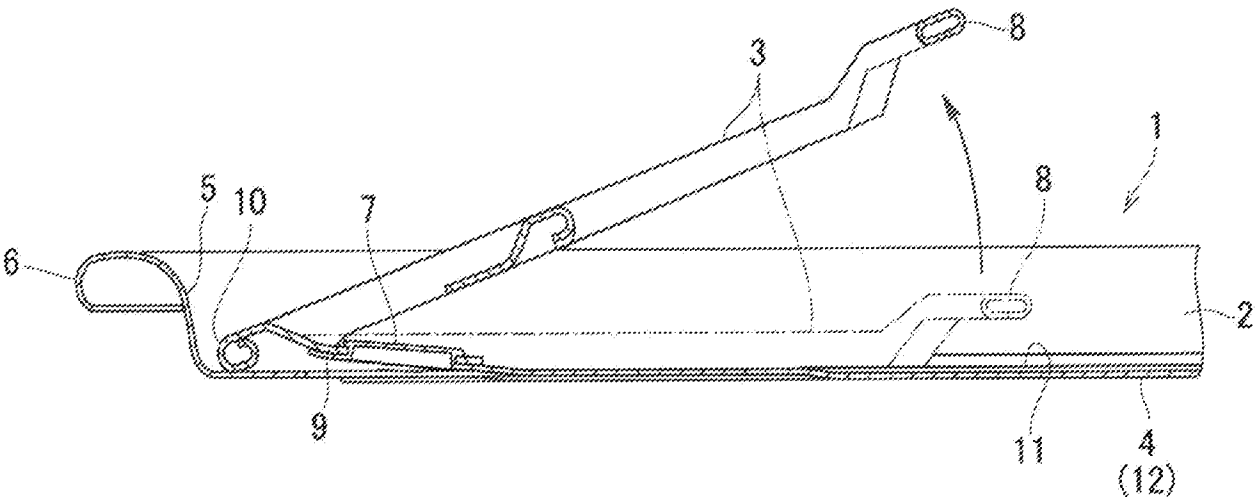
FIG. 7 is a partial cross-sectional view showing an initial rupture of the score line.

The rivet 7 thus lifted is schematically illustrated in FIG. 7. In this situation, the lifting force is applied to the panel portion 4 around the rivet 7. As described, the marginal portion 13*b* of the score line 13 is formed along the rivet 7, and the thickness of the marginal portion 13*b* is reduced. Therefore, the marginal portion 13*b* is ruptured by the force lifting the panel portion 4. That is, the initial rupture of the score line 13 is induced. Specifically, the lifting force applied to the finger grip 8 is multiplied by the class 2 lever action of the tab 3 to serve as a shearing force to rupture the score line 13. In addition, the stiffness of the support section 15 serving as the fulcrum of the class 2 lever action is enhanced by the outer circumferential bead 14, and hence the support section 15 will not be warped significantly. Therefore, an opening force (to open the can lid) established by lifting the finger grip portion 8 can be concentrated as the shearing force to the marginal portion 13*b*. Further, the inner circumferential bead 18 is formed along the inner circumference of the score line 13, and the end portions of the inner circumferential bead 18 are situated on the opening piece 12 in the vicinity of the marginal portion 13*b*. That is, the portion of the opening piece 12 in the vicinity of the marginal portion 13*b* is reinforced by the inner circumferential bead 18. Therefore, the shearing force established by lifting the finger grip portion 8 will not be absorbed by the warpage of the panel portion 4 so that the shearing force can be concentrated to the marginal portion 13*b*. In the can lid 1 according to the present invention, the initial rupture of the score line 13 can be induced easily and certainly. For this reason, easiness to open the can lid 1 can be improved.

Since the rivet 7 is formed on the opening piece 12, the opening piece 12 is lifted partially in the opening direction as a result of rupturing the marginal portion 13*b*. In this situation, the tab 3 is inclined significantly, and hence the rivet 7 or the opening piece 12 is no longer allowed to be further lifted up by the lever action of the tab 3. Therefore, the tab 3 will be pulled in a longitudinal direction (i.e., diagonally upwardly toward right side in FIG. 7) after that. As a result, the opening piece 12 is pulled up from the portion at which the rivet 7 is formed, and the rupture (i.e., shearing) of the score line 13 is propagated from the marginal portion 13*b* toward the connecting portion 13*c*. As described, the connecting portion 13*c* is curved, that is, the connecting portion 13*c* does not extend straight in a direction perpendicular to a direction of action of the pulling force applied to the opening piece 12. Therefore, the connecting portion 13*c* will not be ruptured abruptly but ruptured gradually. For this reason, a large opening force is not required to open the can lid 1. In other words, the score line 13 is ruptured gradually and smoothly so that the opening piece 12 being pulled can be opened smoothly.

In addition, in the can lid 1 according to the present invention, the outer circumferential bead 14 and the inner circumferential bead 18 are formed across the score line 13 so that the rigidity of the opening piece 12 is enhanced in the outer side and the inner side of the score line 13. When the opening piece 12 is pulled up as explained above, the score line 13 is subjected to the shearing force to be ruptured. In this situation, since the rigidity of the opening piece 12 is enhanced in the outer side and the inner side of the score line 13, deformation of those portion can be prevented. Therefore, the shearing force established by pulling up the opening piece 12 is concentrated to the score line 13 so that the score line 13 can be ruptured easily and smoothly.

During the above-explained process, the opening piece 12 is subjected to the bending force. However, as described, the reinforcement depression 19 is formed on the opening piece 12 to enhance the bending stiffness of the opening piece 12. Therefore, the opening piece 12 will not be deformed significantly by the opening force, and the sharing force applied to the score line 13 will not be damped by the deformation of the opening piece 12.

As described, the rupture of the score line 13 propagates from the marginal portion 13*b* toward both sides in the circumferential direction, and intersects at an intermediate portion of the score line 13, that is, at the portion opposite to the marginal portion 13*b*. At the intermediate portion of the score line 13 where the rupture of the score line 13 intersects, a direction of action of the rupturing force and a direction of action of a resistance against the rupturing force are substantially equalized to each other. Consequently, the rupturing force serves as a pulling force to detach the opening piece 12 from the residual ring portion remaining around the opening piece 12. In the can lid 1 according to the present invention, the outer circumferential bead 14 and the inner circumferential bead 18 are formed almost entirely in the circumferential direction on the opening piece 12. That is, the rigidity of the opening piece 12 is also enhanced at the intermediate portion of the score line 13 where the rupture of the score line 13 intersects. Therefore, at a final phase of the propagation of the rupture of the score line 13, the score line 13 may be ruptured neatly without expanding the opening piece 12 and the residual ring portion locally and without creating a burr. For this reason, the can lid 1 may be opened without injuring the finger.

As described, the score line 13 comprises the outer score line 16 and the inner score line 17. Specifically, the outer score line 16 comprises the first groove 16*a*, the second groove 16*b*, and the flat portion 16*c*. Therefore, the residual thickness of the score line 13 may be maintained to a designed value, the thinnest portion of the score line 13 is situated at the center of the thickness of the panel portion 4. For this reason, the score line 13 is allowed to be ruptured by pulling the tab 3 by a constant force, and hence the can lid 1 can be opened smoothly. That is, the easiness to open the can lid 1 may be further improved.

As a result of rupturing the score line 13, edges are created along the outer circumference of the opening piece 12 and the inner circumference of the residual ring portion remaining around the opening piece 12. Nonetheless, the inner circumferential bead 18 is formed along the inner circumference of the score line 13, and the outer circumferential bead 14 is formed on the residual ring portion along the score line 13. Specifically, an outer circumference of the inner circumferential bead 18 is substantially congruent with the edge of the opening piece 12. Likewise, an inner circumference of the outer circumferential bead 14 is substantially congruent with the edge of the residual ring portion. Therefore, when the finger touches those edges, the finger also touches the outer circumference of the inner circumferential bead 18 and the inner circumference of the outer circumferential bead 14. For this reason, the finger is prevented from being injured by the edges. That is, safety of the can lid 1 may be improved.

When rupturing the score line 13, the films covering the inner and outer surfaces of the can lid 1 are also ruptured. As described, in the can lid 1 according to the present invention, those films are solidified into amorphous. Therefore, those films are not allowed to be expanded, and easy to be ruptured. For this reason, the easiness to open the can lid 1 may be further improved.

Thus, the can lid 1 according to the present invention may be opened easily and smoothly. Therefore, the can lid 1 may be formed of aluminum plate material or a steel late material whose rigidity is higher than that of aluminum alloy plate. For this reason, a manufacturing const of the can lid 1 or the can container using the can lid 1 may be reduced. In addition, the can lid 1 may be recycled easily into metallic material.

According to the present invention, the can lid 1 comprises the reinforcement of the support section 15 as the fulcrum to which the nose 10 of the tab 3 is contacted when the tab 3 performs the class 2 lever action. The outer circumferential bead 14 is one example of such reinforcement. However, the present invention should not be limited to the foregoing embodiment. For example, the outer circumferential bead 14 may also be formed in a circular manner to extend even underneath the nose portion 10. As described, the score line 13 may be ruptured continuously and smoothly, and the opening piece 12 may be detached neatly from the residual ring portion, as long as the outer circumferential bead 14 is formed continuously except the support section 15. According to the present invention, however, the outer circumferential bead 14 may also be formed only on the support section 15, or formed intermittently. Likewise, the outer circumferential bead 14 may also be formed only on the portion in the vicinity of the marginal portion 13*b*, or formed intermittently.

REFERENCE SIGNS LIST

1: can lid; 2: main body: 3; tab; 4: panel portion; 5: chuck wall; 6: flange portion; 7: rivet; 8: finger grip portion; 9: installation portion; 10: nose portion; 11: dent; 12: opening piece; 13: score line; 13*a*: main portion; 13*b*: marginal portion; 13*c*: connecting portion; 14: outer circumferential bead; 15: support section; 16: outer score line; 16*a*: first groove; 16*b*: second groove; 16*c*: flat portion; 17: inner score line; 18: inner circumferential bead; 19: reinforcement depression; O: center.

The invention claimed is:

1. A can lid, comprising:

an opening piece enclosed by a score line on a panel portion; and a tab attached to the opening piece and configured to open the can lid by rupturing the score line and detaching the opening piece from the panel portion, wherein the score line is formed into a closed circle to be ruptured along a circumference of the panel portion, a rivet is formed in a vicinity of the circumference of the panel portion, the tab comprises an installation portion that is attached to the rivet, a finger grip portion that is situated closer to a center of the opening piece than the installation portion, and a nose portion that is situated on an opposite side to the finger grip portion at a radially outer side of the score line, a portion of the panel portion underneath the nose portion serves as a support section that supports the nose portion from below, an outer circumferential bead is formed on the radially outer side of the score line to enhance a bending stiffness of the support section, the outer circumferential bead includes end portions situated on both sides of the support section in a circumferential direction of the panel portion, the outer circumferential bead is formed along an outer circumference of the score line while being protruded toward an outer surface of the panel portion, the score line includes a main portion, a marginal portion extending in the vicinity of the rivet, and a connecting portion that connects the main portion to the marginal portion while being curved, the marginal portion is located circumferentially inward with respect to the main portion so that the support section is radially wider than a remaining section of the panel portion at the radially outer side of the score line, a chuck wall is formed entirely along an outer circumference of the panel portion, a residual ring portion is formed on a portion of the panel portion between the score line and the chuck wall, from which the opening piece is detached, the outer circumferential bead is formed on the residual ring portion while curving along the score line and protruding toward the outer surface of the panel portion, a flat portion of the residual ring portion of the panel portion between the end portions of the outer circumferential bead is the support section, and the nose portion of the tab contacts an upper surface of the support section tightly.

2. The can lid as claimed in claim 1, wherein the marginal portion is formed in an arcuate manner along an outer circumference of the rivet between the support section and the rivet, and the main portion is formed along the outer circumferential bead in an arcuate manner around a center of the panel portion.

3. The can lid as claimed in claim 1, wherein an inner circumferential bead is formed on the opening piece along an inner circumference of the score line.

4. The can lid as claimed in claim 3, wherein the inner circumferential bead has an open configuration in which end portions thereof are situated on both sides of the rivet.

5. The can lid as claimed in claim 1, wherein at least the panel portion is formed of a metal plate in which both an outer surface and an inner surface are coated with a resin film respectively, and the resin film is solidified and amorphous.

6. The can lid as claimed in claim 5, wherein the resin film covering the outer surface of the panel portion contains equal to or more than 50 percent of polybutylene terephthalate.

7. The can lid as claimed in claim 1, wherein the outer circumferential bead is formed on the radially outer side of the score line and on a flat outer surface of the panel portion.

8. A can lid, comprising:

an opening piece enclosed by a score line on a panel portion; and a tab attached to the opening piece and configured to open the can lid by rupturing the score line and detaching the opening piece from the panel portion, wherein the score line is formed into a closed circle to be ruptured along a circumference of the panel portion, a rivet is formed in a vicinity of the circumference of the panel portion, the tab comprises an installation portion that is attached to the rivet, a finger grip portion that is situated closer to a center of the opening piece than the installation portion, and a nose portion that is situated on an opposite side to the finger grip portion at a radially outer side of the score line, a portion of the panel portion underneath the nose portion serves as a support section that supports the nose portion from below, an outer circumferential bead is formed on the radially outer side of the score line to enhance a bending stiffness of the support section, the outer circumferential bead includes end portions situated on both sides of the support section in a circumferential direction of the panel portion, the outer circumferential bead is formed along an outer circumference of the score line while being protruded toward an outer surface of the panel portion, the support section is left in the radially outer side of the score line in the panel portion after opening the can lid, a chuck wall is formed entirely along an outer circumference of the panel portion, a residual ring portion is formed on a portion of the panel portion between the score line and the chuck wall, from which the opening piece is detached, the outer circumferential bead is formed on the residual ring portion while curving along the score line and protruding toward the outer surface of the panel portion, and a flat portion of the residual ring portion of the panel portion between the end portions of the outer circumferential bead is the support section.

9. The can lid as claimed in claim 1, wherein the marginal portion is closer to the rivet than the nose portion of the tab and encloses the opening piece.

* * * * *